US005587553A

United States Patent [19]

Braithwaite et al.

[11] Patent Number: 5,587,553

[45] Date of Patent: Dec. 24, 1996

[54] HIGH PERFORMANCE PRESSABLE EXPLOSIVE COMPOSITIONS

[75] Inventors: Paul C. Braithwaite, Brigham City, Utah; Gary K. Lund, Malad, Id.; Robert B. Wardle, Logan, Utah

[73] Assignee: Thiokol Corporation, Odgen, Utah

[21] Appl. No.: 335,097

[22] Filed: Nov. 7, 1994

[51] Int. Cl.[6] ..... C06B 45/10

[52] U.S. Cl. ..... 149/19.6; 149/19.1; 149/45; 149/89; 149/92; 149/105; 149/108.8; 264/3.1

[58] Field of Search ..... 149/19.1, 19.3, 149/19.4, 19.6, 21, 12, 19.92, 88, 105, 11; 264/3.1, 3.3

[56] References Cited

U.S. PATENT DOCUMENTS

| | | | |
|---|---|---|---|
| 3,557,181 | 1/1971 | Lakritz et al. | 260/453 |
| 3,642,830 | 2/1972 | Frankel et al. | 260/348 |
| 3,680,483 | 8/1972 | Staudacher et al. | 102/37.8 |
| 3,907,907 | 9/1975 | Frankel et al. | 260/615 BF |
| 3,943,017 | 5/1976 | Wells | 149/19.8 |
| 4,092,336 | 5/1978 | Frankel et al. | 260/348.45 |
| 4,374,241 | 2/1983 | Adolph | 528/266 |
| 4,405,762 | 9/1983 | Earl et al. | 525/410 |
| 4,923,536 | 5/1990 | Canterberry et al. | 149/19.4 |
| 4,925,503 | 5/1990 | Canterberry et al. | 149/19.4 |
| 5,120,827 | 6/1992 | Willer et al. | 528/408 |
| 5,130,381 | 7/1992 | Ahad | 525/407 |
| 5,162,494 | 11/1992 | Willer et al. | 528/408 |
| 5,164,521 | 11/1992 | Manzara et al. | 552/10 |
| 5,264,596 | 11/1993 | Willer et al. | 549/555 |
| 5,313,000 | 5/1994 | Stewart | 568/613 |
| 5,500,060 | 3/1996 | Holt et al. | 149/19.1 |

*Primary Examiner*—Charles T. Jordan
*Assistant Examiner*—John R. Hardee
*Attorney, Agent, or Firm*—Madson & Metcalf; Ronald L. Lyons

[57] ABSTRACT

High solids pressable explosive compositions containing a liquid energetic polymer and a high performance explosive oxidizer are disclosed. The pressable explosive compositions contain a solids content between 91 and 99 weight percent, with an energetic polymer content less than 9 weight percent. The energetic polymer has a weight average molecular weight greater than 10,000, determined using a polystyrene standard, sufficient to use the polymer precipitation technique in preparing the pressable explosive compositions. Chain-extended PGN (polyglycidyl nitrate) is a preferred energetic polymer. The pressable explosives disclosed herein produce extremely high detonation pressure, high detonation velocity, and excellent metal accelerating capability.

20 Claims, No Drawings

HIGH PERFORMANCE PRESSABLE EXPLOSIVE COMPOSITIONS

FIELD OF THE INVENTION

The present invention relates to high solids pressed explosive compositions. More particularly, the present invention relates to pressed explosive compositions prepared from high molecular weight energetic polymers precipitated onto high performance explosives.

BACKGROUND OF INVENTION

Pressable or extrudable explosive formulations typically include high solids content, from about 89 percent to 99 percent, by weight. For instance, typical extrudable explosives contain from about 89 to 92 percent solids, by weight. A well known extrudable explosive, Composition C4 contains 91% RDX in a binder of polyisobutylene and a liquid plasticizer. Pressable explosives usually contain from 92 to 99 percent solids, by weight. LX-14 is a well known pressable explosive containing 95.5 wt. % HMX and 4.5 wt. % polyurethane resin. Explosive compositions having a solids content below 89 weight percent are generally in the realm of castable explosives.

Polymer precipitation is an important processing technique used to obtain ultra-high solids content pressable explosives. At its simplest, polymer precipitation involves dissolving the polymer in a solvent, adding the dry ingredients and stirring vigorously, then adding a nonsolvent (relative to the polymer and dry ingredients) to the system to cause precipitation of the polymer. Thus, polymer precipitation is used to uniformly coat the dry ingredients with the precipitated polymer. The coated particles are then pressed to high density and into the shape desired for the application selected.

Polymers that have been successfully used in the polymer precipitation process are typically solid at the processing temperature, with a weight average molecular weight greater than about 20,000. Although the actual molecular weight may vary somewhat from polymer to polymer depending on the specific relationship between molecular weight, mechanical properties, and viscosity. High molecular weight is important to efficient polymer precipitation and pressed formulation integrity. Inert polymers have been used because they function as described above and also provide some desensitization of the explosive.

In recent years, energetic polymers, such as PGN (polyglycidyl nitrate), poly-NMMO (nitratomethyl-methyloxetane), poly-BAMO (poly(bis(azidomethyl)oxetane)), poly-AMMO (poly(azidomethylmethyloxetane)), GAP (polyglycidyl azide), and copolymers thereof have been developed and evaluated as replacements of inert polymeric binders in cast propellant systems. Such polymers have also been used in cast explosive compositions and pyrotechnics. However, these energetic polymers are not commercially available in high molecular weights and are typically liquid at normal processing temperatures. Such free flowing liquid binders are generally not suitable in pressable explosives because of problems with growth and exudation.

The substitution of an inert polymer with an energetic polymer in a typical pressable explosive composition will result in higher detonation pressures (typically 20 katm increase) and detonation velocities (typically 100 m/s increase). Because of the ongoing search for very high performance pressable explosives for use in metal accelerating applications, it would be a major advancement in the art to provide high performance high solids pressable explosives prepared from energetic polymers.

Such high performance high solids pressable explosive compositions are disclosed and claimed herein.

SUMMARY OF THE INVENTION

The present invention is directed to high solids pressable explosive compositions containing a liquid energetic polymer and a high performance explosive oxidizer. As used herein, the term "high solids" includes explosives containing less than 11 weight percent energetic polymer. The energetic polymer preferably has a viscosity greater than about 3000 poise, and most preferably a viscosity greater than 5000 poise, as determined using a Brookfield viscometer at 25° C. Such viscosities are typically obtained with energetic polymers having a weight average molecular weight greater than about 10,000 determined using a polystyrene standard. Chain-extended PGN (polyglycidyl nitrate) is a currently preferred energetic polymer. The high performance explosive oxidizer is preferably selected from known and novel nitramine explosives.

The combination of energetic polymers with explosive nitramines results in pressable explosives with extremely high detonation pressure, high detonation velocity, and excellent metal accelerating capability.

DETAILED DESCRIPTION OF THE INVENTION

The present invention is directed to high solids pressable explosive compositions which are significantly more powerful than currently known high solids pressable explosives. The high solids pressable explosive compositions include a liquid energetic polymer and a high performance explosive oxidizer. The oxidizer preferably has a concentration in the pressable explosive composition in the range from about 91 to about 99 weight percent, and most preferably between about 92 and 96 weight percent.

The energetic polymer preferably has a viscosity sufficiently high such that the resulting molding powder explosive is free flowing and easy to process. Typical molding powders comprise generally spherical particles having a size in the range from about 100μ to about 3 mm. If the polymer's viscosity is too high, it may not dissolve in a usable solvent. If the polymer's viscosity is too low then the molding powder will be sticky or tacky, and in some cases growth and exudation will be a problem. The energetic polymer preferably has a viscosity greater than about 3000 poise, and most preferably a viscosity greater than 5000 poise, as determined using a Brookfield viscometer at 25° C.

Defined in other terms, the energetic polymer preferably has a weight average molecular weight greater than 10,000 determined using a polystyrene standard. The upper limit of molecular weight and viscosity is established by the solubility of the polymer, that is, the molecular weight and viscosity may be as high as solubility and processing permit.

Typical energetic polymers which can be used in the present invention include high molecular weight PGN (polyglycidyl nitrate), poly-NMMO (nitratomethyl-methyloxetane), GAP (polyglycidyl azide), 9DT-NIDA (diethyleneglycol-triethyleneglycol-nitraminodiacetic acid terpolymer), poly-BAMO (poly(bis(azidomethyl)oxetane)), poly-AMMO (poly(azidomethylmethyloxetane)), poly-NAMMO (poly(nitraminomethyl-methyloxetane)), poly-BFMO (poly(bis(difluoroaminomethyl)oxetane)), poly-DFMO (poly(difluoroaminomethylmethyloxetane)), and copolymers and mixtures thereof. Those skilled in the art will appreciate that other known and novel energetic polymers not listed above may be used in the present invention. Chain-extended PGN (polyglycidyl nitrate) is a currently preferred energetic polymer.

Typical high explosives which can be used in the present invention include known and novel nitramines such as CL-20 (2,4,6,8,10,12-hexanitro-2,4,6,8,10,12-hexaazatetracyclo[5.5.0.0$^{5,9}$.0$^{3,11}$]-dodecane), RDX (1,3,5-trinitro-1,3,5-triazacyclohexane), HMX (1,3,5,7-tetranitro-1,3,5,7-tetraazacyclooctane), TEX (4,10-dinitro-2,6,8,12-tetraoxa-4,10-diazatetracyclo[5.5.0.0$^{5,9}$.0$^{3,11}$]dodecane), NTO (3-nitro-1,2,4-triazol-5-one), TATB (1,3,5-triamino-2,4,6-trinitrobenzene), TNAZ (1,3,3-trinitroazetidine), ADN (ammonium dinitramide), DADNE (1,1-diamino-2,2-dinitro ethane), and mixtures thereof. Those skilled in the art will appreciate that other known and novel high explosives not listed above may also be used in the present invention.

The present invention is further described in the following nonlimiting examples.

EXAMPLE 1

Chain extended PGN (E-PGN) was prepared by dissolving 11.2 grams PGN in 25 mL of $CH_2Cl_2$ under nitrogen gas. HDI (hexamethylene diisocyanate) (0.53 mL) and dibutyltindiacetate (small drop) were added to the mixture. FTIR (Fourier Transform Infrared) analysis at 48 hours shows urethane bonds and no —NCO bonds. The product is isolated by pouring into methanol and washing with methanol. The molecular weight of the original PGN and chain extended PGN were determined to be the following:

| | Mw | Mn | Mw/Mn |
|---|---|---|---|
| PGN | 3900 | 2030 | 1.91 |
| E-PGN | 16800 | 4830 | 3.48 |

Mw and Mn are the weight average and number average molecular weights, respectively, and were determined by GPC (gel permeation chromatography) using polystyrene as the calibration standard according to conventional techniques.

EXAMPLE 2

Chain extended PGN was prepared according to the procedure of Example 1, except that 13.4 grams of PGN were dissolved in 30 mL of $CH_2Cl_2$ and 0.713 mL of HDI were added to the mixture. The molecular weight of the original PGN and chain extended PGN were determined to be the following:

| | Mw | Mn | Mw/Mn |
|---|---|---|---|
| PGN | 3900 | 2030 | 1.91 |
| E-PGN | 13200 | 3580 | 3.69 |

EXAMPLE 3

Chain extended PGN was prepared according to the procedure of Example 1, except that 100 grams of PGN were dissolved in 330 mL of $CHCl_3$ and 5.37 mL of HDI and 3 drops dibutyl tin diacetate (DBTDA) were added to the mixture. The molecular weight of the original PGN and chain extended PGN were determined to be the following:

| | Mw | Mn | Mw/Mn |
|---|---|---|---|
| PGN | 7820 | 2880 | 2.72 |
| E-PGN | 22000 | 5460 | 4.03 |

Those skilled in the art will appreciate that the molecular weight of chain extended PGN can be varied. The final molecular weight is affected by the relative amount of isocyanate to alcohol. The molecular weight is maximized when the ratio of isocyanate to alcohol is 1. The molecular weight decreases as one deviates from the stoichiometric ratio. In practice, excess alcohol is preferred to prevent the presence of unreacted isocyanate.

EXAMPLE 4

The viscosity of certain PGN and chain extended PGN compositions measured using a Brookfield viscometer at 25° C. The viscosity results, together with molecular weight data determined using a polystyrene standard, are reported below:

| | Mw | Mn | Mw/Mn | Viscosity |
|---|---|---|---|---|
| PGN | 7820 | 2880 | 2.72 | 630 poise |
| E-PGN | 36200 | 7040 | 5.14 | 6060 poise |
| E-PGN | 7320 | 3210 | 2.28 | 2250 poise |

High solids pressable explosives were prepared using the two chain extended PGN compositions described above. The lower molecular weight chain extended PGN composition produced a pressable explosive composition that was somewhat tacky. Although pressable explosive material was prepared, the tacky physical characteristic was marginally acceptable.

EXAMPLE 5

A high solids pressable explosive was prepared by dissolving 8.15 grams of the high molecular weight PGN prepared in Example 1 in 32.6 grams of methylene chloride (80 percent solvent and 20 percent polymer, by weight). The PGN readily dissolved into solution after shaking the container for approximately five minutes. Using the PGN/methylene chloride solution, a series of small explosive mixes, were processed with CL-20 solids loadings from 85 to 95 weight percent. The mixes had the following compositions:

| Mix No. | Composition |
|---|---|
| A | 9.0 g CL-20 (2 g 7μ, 7 g unground)/5 g solution |
| B | 9.0 g CL-20 (unground)/5 g solution |
| C | 14.25 g CL-20 (unground)/3.75 g solution |
| D | 8.5 g CL-20 (unground)/7.5 g solution |

In mix D a small amount of MNA (N-methyl-p-nitroaniline) was added to the PGN/methylene chloride solution to act as a stabilizer for the PGN. MNA is a standard nitrate ester stabilizer. The mixes were processed using the polymer precipitation/coacervation technique using hexanes as the nonsolvent. In this technique, a solution of methylene chloride and PGN with excess methylene chloride was added to a reactor vessel and stirred vigorously. While stirring, the solid ingredients (CL-20) were added. After the solids were uniformly dispersed, the nonsolvent (hexanes) was slowly added to the mixture. Adding the nonsolvent caused the polymer to precipitate on to the solids. Excess hexanes were added and the liquids were decanted. Acceptable molding powders were formed from each mix.

EXAMPLE 6

A high solids pressable explosive was prepared by dissolving 11.0 grams of the high molecular weight PGN prepared in Example 2 in 44.0 grams of methylene chloride (80 percent solvent and 20 percent polymer, by weight). The PGN readily dissolved into solution after shaking the container for approximately five minutes. Using the PGN/methylene chloride solution, a high solids (93 weight percent) pressable explosive composition was prepared as follows: Into 24.5 g of the methylene chloride solution (which contained 4.9 g of the high molecular weight PGN), were added 45.1 g of unground CL-20, 20.0 g ground CL-20 (7μ to 20μ), and 0.1 g MNA. The mixture was processed using the polymer precipitation, coacervation technique described in Example 5.

The resulting molding powder explosive was pressed into ½-inch diameter by ½-inch thick pellets having an average pellet density of 1.928 g/cc based on a diameter of 0.502 inches. These pellets were loaded into insensitive high-explosives (IHE) card gap pipes and the shock sensitivity was determined. In the standard "card gap" test, an explosive primer is set off a certain distance from the explosive. The space between the primer and the explosive charge is filled with an inert material such as PMMA (polymethylmethacrylate). The distance is expressed in cards, where 1 card is equal to 0.01 inch such that 70 cards is equal to 0.7 inches. If the explosive does not detonate at 70 cards, for example, then the explosive is nondetonable at 70 cards.

The shock sensitivity was determined to be between 225 and 231 cards. These results indicate that the shock sensitivity of this explosive is satisfactory and that the explosive is detonable.

EXAMPLE 7

A high solids pressable explosive was prepared by dissolving 4.9 grams of the high molecular weight PGN prepared in Example 3 in approximately 25 grams of methylene chloride (approximately 80 percent solvent and 20 percent polymer, by weight). The PGN readily dissolved into solution after shaking the container for approximately five minutes. Using the PGN/methylene chloride solution, a high solids (95 weight percent) pressable explosive composition was prepared as follows: Into approximately 25 g of the methylene chloride solution (which contained 4.9 g of the high molecular weight PGN), were added 50.26 g of unground CL-20, 34.74 g of medium ground CL-20 (approximately 30μ), 10.0 g ground CL-20 (7μ to 20μ), and 0.1 g 4-NDPA (4-nitrodiphenylamine). The mixture was processed using the polymer precipitation, coacervation technique described in Example 5. The mix processed well and was dried in a vacuum oven to remove the solvent. After drying, the composition was a dry, free flowing powder.

EXAMPLE 8

Several 10 gram, high solids pressable explosive compositions were prepared using poly-NMMO (nitratomethylmethyloxetane) as the binder. The poly-NMMO had a weight average molecular weight of 9790 and a number average molecular weight of 5070, determined using a polystyrene standard. The explosive compositions were prepared using the technique described in Example 5. The compositions had the following ingredients:

| Composition | Ingredients (weight percent) |
|---|---|
| 7A | 90% HMX/10% NMMO |
| 7B | 95% HMX/5% NMMO |
| 7C | 90% CL-20/10% NMMO |
| 7D | 95% CL-20/5% NMMO |
| 7E | 87.34% HMX/12.66% NMMO |

The material was tested to determine its safety characteristics. Safety tests were run using standard methodologies common the those skilled in the art. It should noted that TC (Thiokol Corporation) tests are 50% fire values and ABL (Allegheny Ballistics Laboratory) numbers are threshold initiation values. The results were as follows:

| | Impact | | Friction | | ESD | | |
|---|---|---|---|---|---|---|---|
| | TC (inch) | ABL (cm) | TC (lb) | ABL (psi @ ft/s) | TC (J) | SBAT (°F.) | DSC (°C.) |
| 7A | 29.7 | 6.9 | >64 | 420/8 | >8 | 270 | 280 |
| 7B | 28.0 | 6.9 | >64 | 240/8 | >8 | 282 | 282 |
| 7C | 22.5 | 1.8 | >40.5 | 180/6 | >8 | 283 | 231 |
| 7D | 26.3 | 3.5 | 30.5 | 50/8 | >8 | 285 | 242 |
| 7E | 21.0 | 21 | >64 | 420/8 | >8 | 260 | 278 |

ESD = Electrostatic Discharge
SBAT = Simulated Bulk Autoignition Temperature.
DSC = Differential Scanning Calorimeter, base line departure.

These data are typical of high performance explosives.

EXAMPLE 9

An explosive mix of 95 grams HMX and 5.0 grams NMMO was prepared according to Example 8. Card gap testing of the explosive composition was conducted. The test results are summarized below:

| Test | Cards | Results |
|---|---|---|
| 1 | 0 | Detonated |
| 2 | 201 | Detonated |
| 3 | 225 | Detonated |
| 4 | 235 | Not Detonated |
| 5 | 230 | Marginally Detonated |

These results indicate that the shock sensitivity of this explosive is satisfactory and that the explosive is detonable.

EXAMPLE 10

High solids pressable explosive compositions were prepared by dissolving 4.0 grams of the high molecular weight PGN prepared in Example 3 in approximately 16 grams of methylene chloride (approximately 80 percent solvent and 20 percent polymer, by weight). The PGN readily dissolved into solution after shaking the containing for less than five minutes. Using the PGN/methylene chloride solution, high solids explosive compositions were prepared having the following ingredients:

| Mix | Ingredients |
|---|---|
| 9A | 4.0 g PGN/76.0 g TEX |
| 9B | 4.0 g PGN/46 g unground NTO and 30 g ground NTO |

The compositions were prepared using the polymer precipitation, coacervation technique described in Example 5. The mixes processed well and was dried in a vacuum oven to remove the solvent. After drying, the compositions were dry, free flowing powders.

EXAMPLE 11

Computer modeling calculations comparing the theoretical explosive performance (detonation pressure and velocity at the Chapman-Jouguet (C-J) condition) of 90 and 95 weight percent HMX and CL-20 pressed explosives in high molecular weight PGN and in an ethylene vinyl acetate (EVA) inert binder were conducted utilizing the BKW equation of state. The calculations are summarized below:

| Composition | Density (g/cc) | Predicted C-J Det. Pressure | Predicted C-J Det. Velocity |
|---|---|---|---|
| 90% HMX/10% PGN | 1.843 | 367 katm | 8841 m/s |
| 90% HMX/10% EVA | 1.771 | 340 katm | 8694 m/s |
| 90% CL-20/10% PGN | 1.960 | 392 katm | 8833 m/s |
| 90% CL-20/10% EVA | 1.879 | 364 katm | 8676 m/s |
| 95% HMX/5% PGN | 1.871 | 379 katm | 8942 m/s |
| 95% HMX/5% EVA | 1.833 | 365 katm | 8863 m/s |
| 95% CL-20/5% PGN | 1.999 | 408 katm | 8940 m/s |
| 95% CL-20/5% EVA | 1.956 | 393 katm | 8854 m/s |

As these calculations illustrate, significant performance advantages are obtained using high molecular weight PGN in a high solids explosive. The high performance is a direct result of PGN's favorable oxygen balance, reasonable heat of formation, and high density.

EXAMPLE 12

Four one-inch diameter explosive pellets were prepared by pressing the 95% CL-20/5% PGN explosive composition described in Example 7. The pressed pellets were tested to determine detonation velocity. The pressing conditions, pressed density, and detonation velocity are summarized below:

| Pellet # | Pressing Conditions | Pressed Density (g/cc) | Detonation Velocity (m/s) |
|---|---|---|---|
| 1 | 5K ram × 15 sec. | 1.751 | 8448 |
| 2 | 5K ram × 25 sec.<br>10K ram × 25 sec. | 1.841 | 8722 |
| 3 | 5K ram × 25 sec.<br>10K ram × 25 sec.<br>20K ram × 25 sec. | 1.917 | 8958 |
| 4 | 5K ram × 15 sec.<br>10K ram × 15 sec.<br>20K ram × 15 sec.<br>30K ram × 15 sec. | 1.932 | 9013 |

The maximum measured detonation velocity is considerably higher than the detonation velocity of the current state of the art explosive LX-14 (95.5% HMX, 4.5% Estane® (a polyurethane binder manufactured by B. F. Goodrich)) which has a detonation velocity of 8826 m/s at a density of 1.835 g/cc.

EXAMPLE 13

Eight one-inch diameter pellets of composition 9A (95% TEX/5% PGN) and 9B (95% NTO/5% PGN) were prepared by pressing under different conditions to give a range of densities. The pressed pellets were tested to determine the detonation velocity of the explosive. The density and detonation velocity of each pellet are summarized below:

| Composition | Pellet # | Percent Theoret. Density | Pressed Density (g/cc) | Detonation Velocity (m/s) |
|---|---|---|---|---|
| 9A | 1 | 85.5 | 1.6702 | 6840 |
| 9A | 2 | 85.9 | 1.6776 | 6819 |
| 9A | 3 | 89.7 | 1.7522 | 6775 |
| 9A | 4 | 94.7 | 1.8492 | 7179 |
| 9A | 5 | 94.8 | 1.8511 | 7198 |
| 9A | 6 | 95.4 | 1.8631 | 7325 |
| 9A | 7 | 95.6 | 1.8677 | 7365 |
| 9A | 8 | 95.8 | 1.8710 | 7303 |
| 9B | 1 | 90.7 | 1.7220 | 7638 |
| 9B | 2 | 92.7 | 1.7604 | 7729 |
| 9B | 3 | 93.2 | 1.7704 | 7768 |
| 9B | 4 | 94.9 | 1.8015 | 7857 |
| 9B | 5 | 95.9 | 1.8216 | 7938 |
| 9B | 6 | 96.3 | 1.8274 | 7922 |
| 9B | 7 | 96.3 | 1.8274 | 7932 |
| 9B | 8 | 97.3 | 1.8468 | 7972 |

From the foregoing, it will be appreciated that the present invention provides high performance high solids pressable explosives prepared from energetic polymers.

The present invention may be embodied in other specific forms without departing from its essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The claimed invention is:

1. A high solids pressable explosive composition comprising:

a liquid energetic polymer having a weight average molecular weight greater than 10,000 determined using a polystyrene standard; and a high explosive having a concentration in the pressable explosive composition in the range from about 91 weight percent to about 99 weight percent.

2. A high solids pressable explosive composition as defined in claim 1, wherein the high explosive is selected from CL-20 (2,4,6,8,10,12-hexanitro-2,4,6,8,10,12-hexaazatetracyclo[5.5.0.0$^{5,9}$.0$^{3,11}$]-dodecane), RDX (1,3,5-trinitro-1,3,5-triazacyclohexane), HMX (1,3,5,7-tetranitro-1,3,5,7-tetraazacyclooctane), TEX (4,10-dinitro-2,6,8,12-tetraoxa-4,10-diazatetracyclo[5.5.0.0$^{5,9}$.0$^{3,11}$]dodecane), NTO (3-nitro-1,2,4-triazol-5-one), TATB (1,3,5-triamino-2,4,6-trinitrobenzene), TNAZ (1,3,3-trinitroazetidine), ADN (ammonium dinitramide), DADNE (1,1-diamino-2,2-dinitro ethane), and mixtures thereof.

3. A high solids pressable explosive composition as defined in claim 1, wherein the energetic polymer has a viscosity greater than about 3000 poise.

4. A high solids pressable explosive composition as defined in claim 1, wherein the energetic polymer has a viscosity greater than about 5000 poise.

5. A high solids pressable explosive composition as defined in claim 1, wherein the energetic polymer is selected from PGN (polyglycidyl nitrate), poly-NMMO (nitratomethylmethyloxetane), GAP (polyglycidyl azide), 9DT-NIDA (diethyleneglycol-triethyleneglycol-nitraminodiacetic acid terpolymer), poly-BAMO (poly(bisazidomethyloxetane)), poly-AMMO (poly(azidomethyl-methyloxetane)), poly-NAMMO (poly(nitraminomethyl-methyloxetane)), and copolymers and mixtures thereof.

6. A high solids pressable explosive composition as defined in claim 1, wherein the energetic polymer is chain-extended PGN (polyglycidyl nitrate).

7. A high solids pressable explosive composition as defined in claim 1, wherein the high explosive has a concentration in the pressable explosive composition in the range from about 92 weight percent to about 96 weight percent.

8. A high solids pressable explosive composition as defined in claim 1, wherein the liquid energetic polymer is precipitated onto the high explosive to form a molding powder from which the high solids pressable explosive is pressed.

9. A high solids pressable explosive composition comprising:

a chain-extended PGN (polyglycidyl nitrate) having a weight average molecular weight greater than 10,000 determined using a polystyrene standard; and a high explosive having a concentration in the pressable explosive composition in the range from about 92 weight percent to about 96 weight percent.

10. A high solids pressable explosive composition as defined in claim 9, wherein the high explosive is selected from CL-20 (2,4,6,8,10,12-hexanitro-2,4,6,8,10,12-hexaazatetracyclo[5.5.0.0$^{5,9}$.0$^{3,11}$]-dodecane), RDX (1,3,5-trinitro-1,3,5-triazacyclohexane), HMX (1,3,5,7-tetranitro-1,3,5,7-tetraazacyclooctane), TEX (4,10-dinitro-2,6,8,12-tetraoxa-4,10-diazatetracyclo[5.5.0.0$^{5,9}$.0$^{3,11}$]dodecane), NTO (3-nitro-1,2,4-triazol-5-one), TATB (1,3,5-triamino-2,4,6-trinitrobenzene), TNAZ (1,3,3-trinitroazetidine), ADN (ammonium dinitramide), DADNE (1,1-diamino-2,2-dinitro ethane), and mixtures thereof.

11. A high solids pressable explosive composition as defined in claim 9, wherein the high explosive is selected from CL-20 (2,4,6,8,10,12-hexanitro-2,4,6,8,10,12-hexaazatetracyclo[5.5.0.0$^{5,9}$.0$^{3,11}$]-dodecane), HMX (1,3,5,7-tetranitro-1,3,5,7-tetraazacyclooctane), and mixtures thereof.

12. A high solids pressable explosive composition as defined in claim 9, wherein the high explosive is selected from TEX (4,10-dinitro-2,6,8,12-tetraoxa-4,10-diazatetracyclo[5.5.0.0$^{5,9}$.0$^{3,11}$]dodecane), NTO (3-nitro-1,2,4-triazol-5-one), and mixtures thereof.

13. A high solids pressable explosive composition as defined in claim 9, wherein the chain-extended PGN is precipitated onto the high explosive to form a molding powder from which the high solids pressable explosive is pressed.

14. A high solids pressable explosive composition comprising:

a liquid energetic polymer having a viscosity greater than about 3000 poise; and a high performance explosive oxidizer having a concentration in the pressable explosive composition in the range from about 91 weight percent to about 99 weight percent.

15. A high solids pressable explosive composition as defined in claim 14, wherein the liquid energetic polymer has a viscosity greater than about 5000 poise.

16. A high solids pressable explosive composition as defined in claim 14, wherein the high explosive is selected from CL-20 (2,4,6,8,10,12-hexanitro-2,4,6,8,10,12-hexaazatetracyclo[5.5.0.0$^{5,9}$.0$^{3,11}$]-dodecane), RDX (1,3,5-trinitro-1,3,5-triazacyclohexane), HMX (1,3,5,7-tetranitro-1,3,5,7-tetraazacyclooctane), TEX (4,10-dinitro-2,6,8,12-tetraoxa-4,10-diazatetracyclo[5.5.0.0$^{5,9}$.0$^{3,11}$]dodecane), NTO (3-nitro-1,2,4-triazol-5-one), TATB (1,3,5-triamino-2,4,6-trinitrobenzene), TNAZ (1,3,3-trinitroazetidine), ADN (ammonium dinitramide), DADNE (1,1-diamino-2,2-dinitro ethane), and mixtures thereof.

17. A high solids pressable explosive composition as defined in claim 14, wherein the energetic polymer is selected from PGN (polyglycidyl nitrate), poly-NMMO (nitratomethylmethyloxetane), GAP (polyglycidyl azide), 9DT-NIDA (diethyleneglycol-triethyleneglycol-nitramino-diacetic acid terpolymer), poly-BAMO (poly(bisazidomethyloxetane)), poly-AMMO (poly(azidomethyl-methyloxetane)), poly-NAMMO (poly(nitraminomethyl-methyloxetane)), and copolymers and mixtures thereof.

18. A high solids pressable explosive composition as defined in claim 14, wherein the energetic polymer is chain-extended PGN (polyglycidyl nitrate).

19. A high solids pressable explosive composition as defined in claim 14, wherein the high explosive has a concentration in the pressable explosive composition in the range from about 92 weight percent to about 96 weight percent.

20. A high solids pressable explosive composition as defined in claim 14, wherein the liquid energetic polymer is precipitated onto the high explosive to form a molding powder from which the high solids pressable explosive is pressed.

* * * * *